US005754001A

United States Patent [19]

Ohno et al.

[11] Patent Number: 5,754,001

[45] Date of Patent: May 19, 1998

[54] DISPLAY DEVICE

[75] Inventors: Katsutoshi Ohno, Tokyo; Tsuneo Kusunoki, Kanagawa, both of Japan

[73] Assignee: Sony Corporation, Tokyo, Japan

[21] Appl. No.: 567,628

[22] Filed: Dec. 5, 1995

Related U.S. Application Data

[63] Continuation of Ser. No. 202,124, Feb. 25, 1994, abandoned.

[30] Foreign Application Priority Data

Feb. 26, 1993 [JP] Japan ..... 5-038892
May 20, 1993 [JP] Japan ..... 5-118606

[51] Int. Cl.[6] ..... H01J 63/04; H01J 5/16

[52] U.S. Cl. ..... 313/497; 313/112; 313/306

[58] Field of Search ..... 313/485, 514, 313/581, 585, 306, 308, 310, 474, 112, 495, 496, 497, 466, 467; 359/885, 614, 890, 891; 348/786, 835

[56] References Cited

U.S. PATENT DOCUMENTS 3,114,065 12/1963 Kaplan ..... 313/112 X
3,891,440 6/1975 Gallaro et al. ..... 313/472 X
4,595,862 6/1986 Morimoto et al. ..... 313/497 X
4,661,743 4/1987 Matsuoka et al. ..... 313/497 X
4,757,234 7/1988 Ikuta et al. ..... 313/112 X

OTHER PUBLICATIONS

Tsuruoka et al, Two-color Graphic FLVFD with internal color filters, pp. 1–2, Dec. 1992.

*Primary Examiner*—Ashok Patel
*Attorney, Agent, or Firm*—Hill, Steadman & Simpson

[57] ABSTRACT

A display device such as a color phosphor display panel has a panel assembly comprising a faceplate, a pair of spaced side plates, and a backplate 1*c* which are joined together to provide an evacuated interior space. The display device includes a color filter layer having red, green, and blue filters disposed on the inner surface of the faceplate, the filter layer containing fine particles of inorganic metal compounds. A plurality of phosphor layers of ZnO:Zn are disposed on the color filter layer. A grid is disposed in spaced relation between the phosphor layers and a cathode for controlling a flow of thermions emitted from the cathode toward the phosphor layers. The fine particles of inorganic metal compounds have a particle size ranging from 0.01 μm to 0.02 μm. Preferably, the red filter contains fine particles of $Fe_2O_3$, the green filter contains fine particles of $TiO_2$.ZnO.CoO.NiO, and the blue filter contains fine particles of CoO.$Al_2O_3$. The phosphor layers are made of ZnO:Zn.

10 Claims, 7 Drawing Sheets

DISPLAY DEVICE

This is a continuation of application Ser. No. 08/202,124, filed Feb. 25, 1994, now abandoned.

BACKGROUND OF THE INVENTION

1. Field of the Invention

The present invention relates to a display device for use as a color phosphor display panel, for example, in a speedometer on an automobile, for example.

2. Description of the Prior Art

There have heretofore been known color phosphor display tubes comprising a combination of a bluish green phosphor ZnO:Zn and color filters. The materials of the color filters that are used have to be thermally stable because a heat treatment process is usually carried out at about 500° C. when such a color phosphor display tube is manufactured. The color filters for use in those color phosphor display tubes are thus made of inorganic materials, rather than organic materials that are used in liquid crystal display panels, for example.

It is preferable that the color filters have a high transmittance so as not to reduce the intensity of light emitted from the phosphor, and also have a low reflectance.

The materials that have found wide use in the art are metal colloids (see, for example, "Two-color Graphic FLVFD with Internal Color Filters" by Yoshihisa Tsuruoka & Yoshinari Okamoto, proceeding Japan Display, P1-2 (1992)).

However, as shown in FIG. 1 of the accompanying drawings, red and blue filters of the conventional materials transmit light having wavelengths other than those of red and blue light. Therefore, the chromaticity points on a CIE chromaticity diagram shown in FIG. 2 of the accompanying drawings are represented by red: x/y=0.347/0.281, bluish green: x/y=0.235/0.405, and blue: x/y=0.260/0.297, resulting in a narrow color reproducing range. Consequently, no satisfactory colors can be produced by the conventional color phosphor display tubes.

OBJECTS AND SUMMARY OF THE INVENTION

It is therefore an object of the present invention to provide a display device capable of reproducing colors in a wide color reproducing range.

According to the present invention, there is provided a display device comprising a faceplate, a color filter layer comprising red, green, and blue filters disposed on said faceplate, said filter layer containing fine particles of inorganic metal compounds, a plurality of phosphor layers disposed on said color filter layer, a cathode for emitting thermions toward said phosphor layers, and a grid disposed in spaced relation between said phosphor layers and said cathode for controlling a flow of thermions emitted from said cathode toward said phosphor layers.

The fine particles of inorganic metal compounds may have a particle size ranging from 0.01 μm to 0.02 μm.

The red filter may contain fine particles of $Fe_2O_3$. The green filter may contain fine particles of $TiO_2$.ZnO.CoO.NiO. The blue filter may contain fine particles of CoO.$Al_2O_3$.

The display device may further comprise an indium tin oxide layer disposed between said color filter layer and said phosphor layers.

The phosphor layers may be made of ZnO:Zn.

The red, green, and blue filters are capable of separating red, green, and blue light more effectively from light emitted by the phosphor layers 7 than the conventional color filters. As a result, the display device can emit light of purer three primaries. Since the color filters contain fine particles of inorganic metal compounds, these fine particles do not reduce the transmittance of light passing therethrough.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 1:
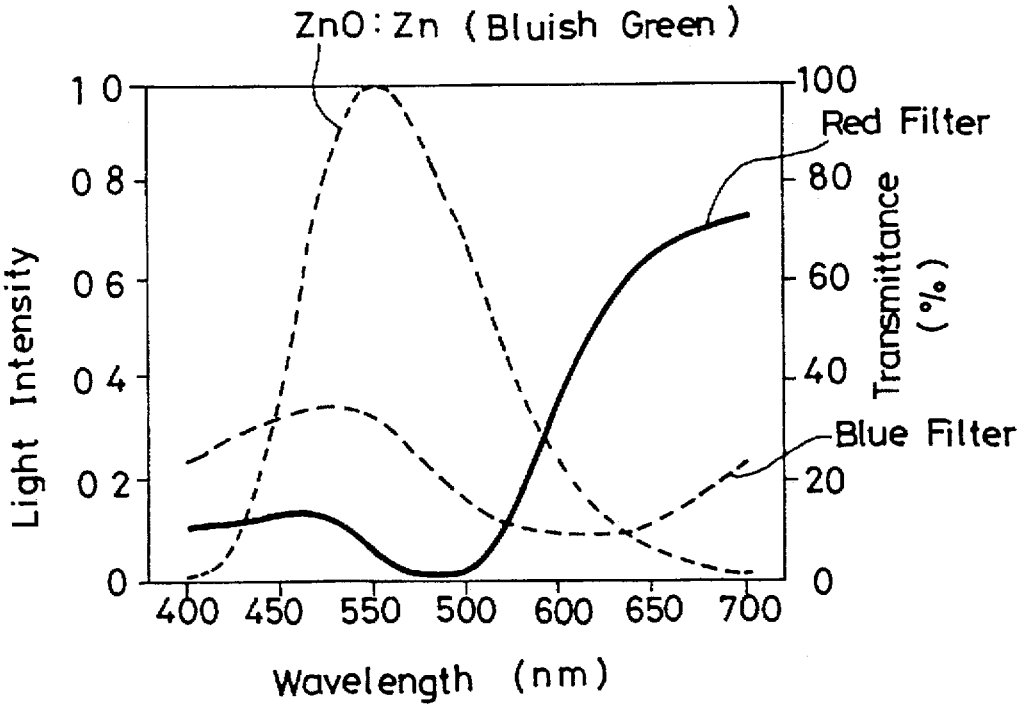
FIG. 1 (PRIOR ART)
FIG. 1 is a diagram showing transmittance characteristics of conventional color filters.
Figure 2:
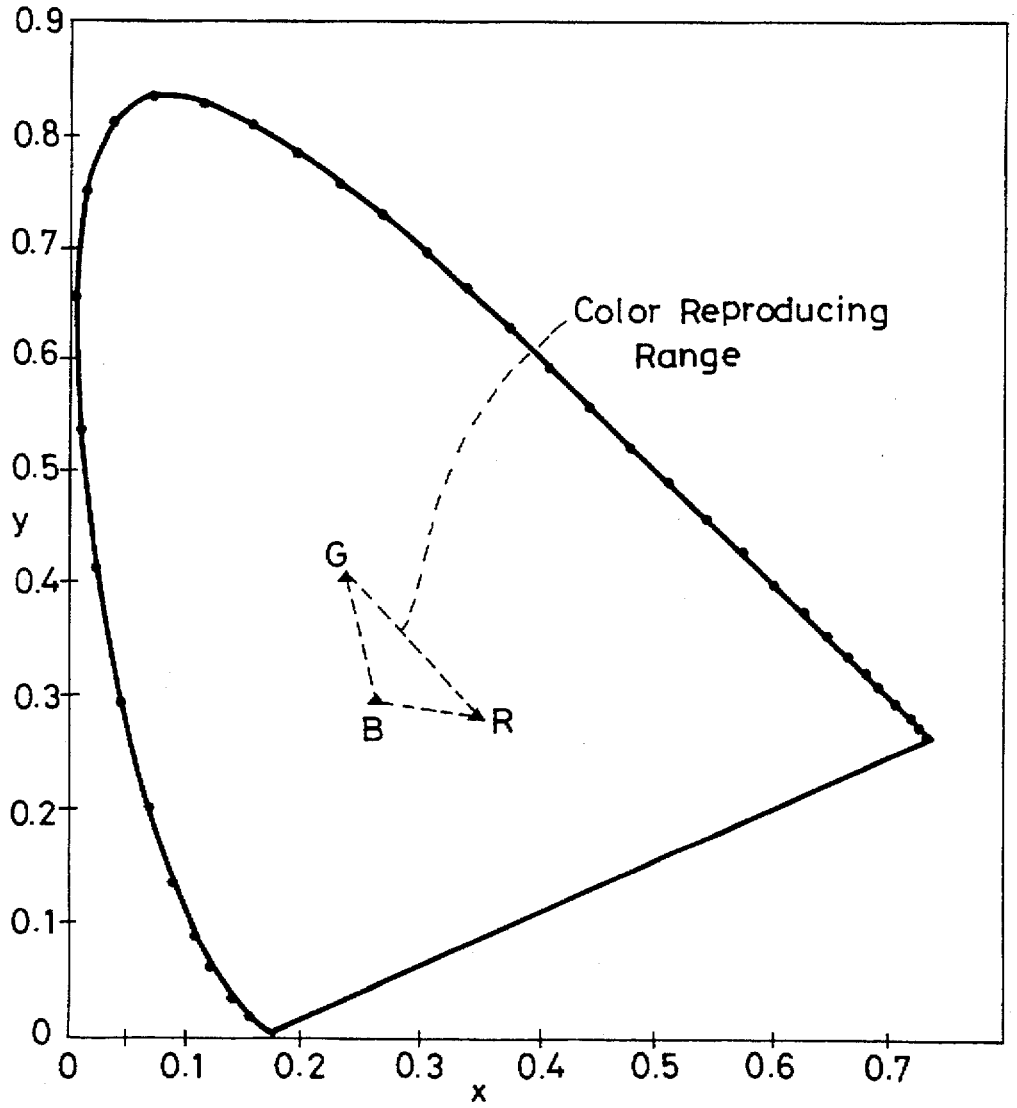
FIG. 2 (PRIOR ART)
FIG. 2 is a diagram illustrative of a color reproducing range of the conventional color filters on a CIE chromaticity diagram.
Figure 3A:
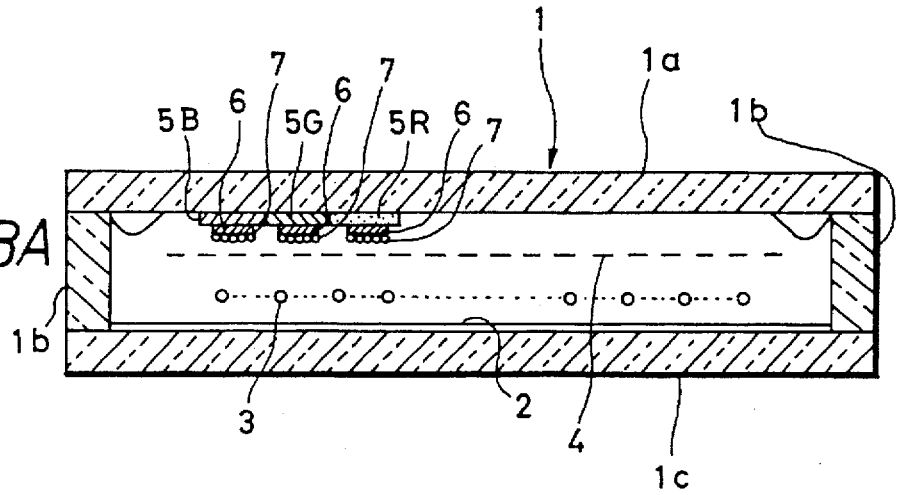
FIG. 3A is a cross-sectional view of a front-emission phosphor display panel as a display device according to the present invention.

As shown in FIG. 3A, a front-emission phosphor display panel as a display device according to the present invention includes a panel assembly 1 comprising a faceplate 1*a* of glass, a pair of spaced side plates 1*b* of glass joined at one edges thereof to the faceplate 1*a*, and a backplate 1*c* joined to opposite edges of the side plates 1*b*. The panel assembly 1 has an evacuated interior space which is defined by the faceplate 1*a*, the side plates 1*b*, and the back plate 1*c*. An electrostatic and light shield film 2 is disposed on the inner surface of the backplate 1*c* that faces the evacuated interior space in the panel assembly 1. The panel assembly 1 houses therein filaments 3 and a grid 4 that are successively arranged in the order named in a direction from the backplate 1*c* toward the faceplate 1*a*. The filaments 3 serve as a cathode for emitting thermions, and the grid 4, which is spaced from and disposed between the filaments 3 and the faceplate 1*a*, serves to control the flow of emitted thermions.

A color filter layer composed of red, green, and blue filters 5R, 5G, 5B is deposited on the inner surface of the faceplate 1*a* according to a process described later on. On each of the filters 5R, 5G, 5B, there are disposed a transparent indium tin oxide (ITO) layer 6 that serves as an anode on the filter and a phosphor layer 7 on the ITO layer 6. The phosphor layer 7 is made of a phosphor ZnO:Zn which emits bluish green light.

A pigment of $Fe_2O_3$ is dispersed in the red filters 5R. A pigment of $TiO_2$.NiO.CoO.ZnO (1:1:1:1) is dispersed in the green filters 5G. A pigment of CoO.$Al_2O_3$ (1:1) is dispersed in the blue filters 5B. These pigments should preferably have a particle size ranging from 0.01 μm to 0.01 μm for increased filter transmittance. It is well known in the art that the transmittance of a filter is increased if the size of particles dispersed in the filter is sufficiently smaller than ½ of the wavelength of light incident on the filter.

Figure 3B:
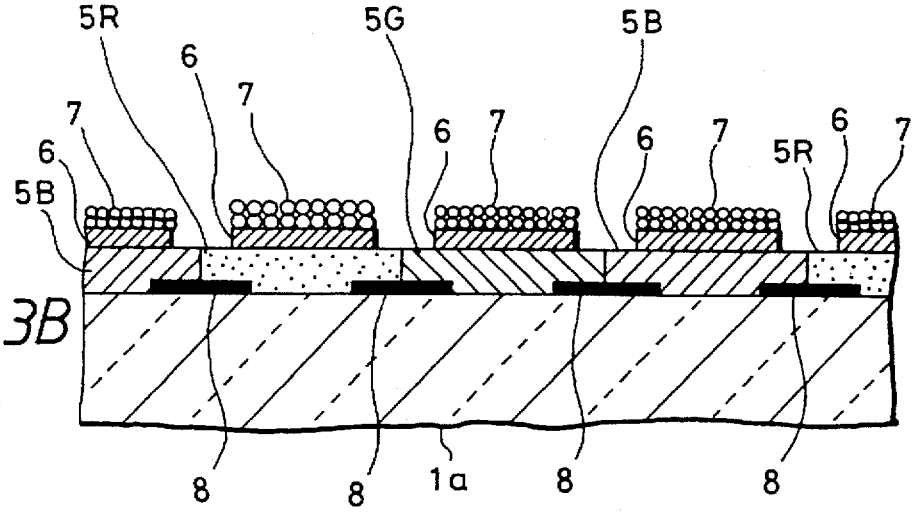
FIG. 3B is an enlarged fragmentary cross-sectional view of a portion of the display device according to the present invention.

As shown in FIG. 3B, black stripes 8 made of carbon, $Fe_3O_4$, an insulating material, or the like are interposed at predetermined spaced intervals between the faceplate 1*a* and the filters 5R, 5G, 5B for increasing the contrast of displayed images. Each of the filters 5R, 5G, 5B is arranged so as to lie over adjacent two of the black stripes 8.

Figure 4:
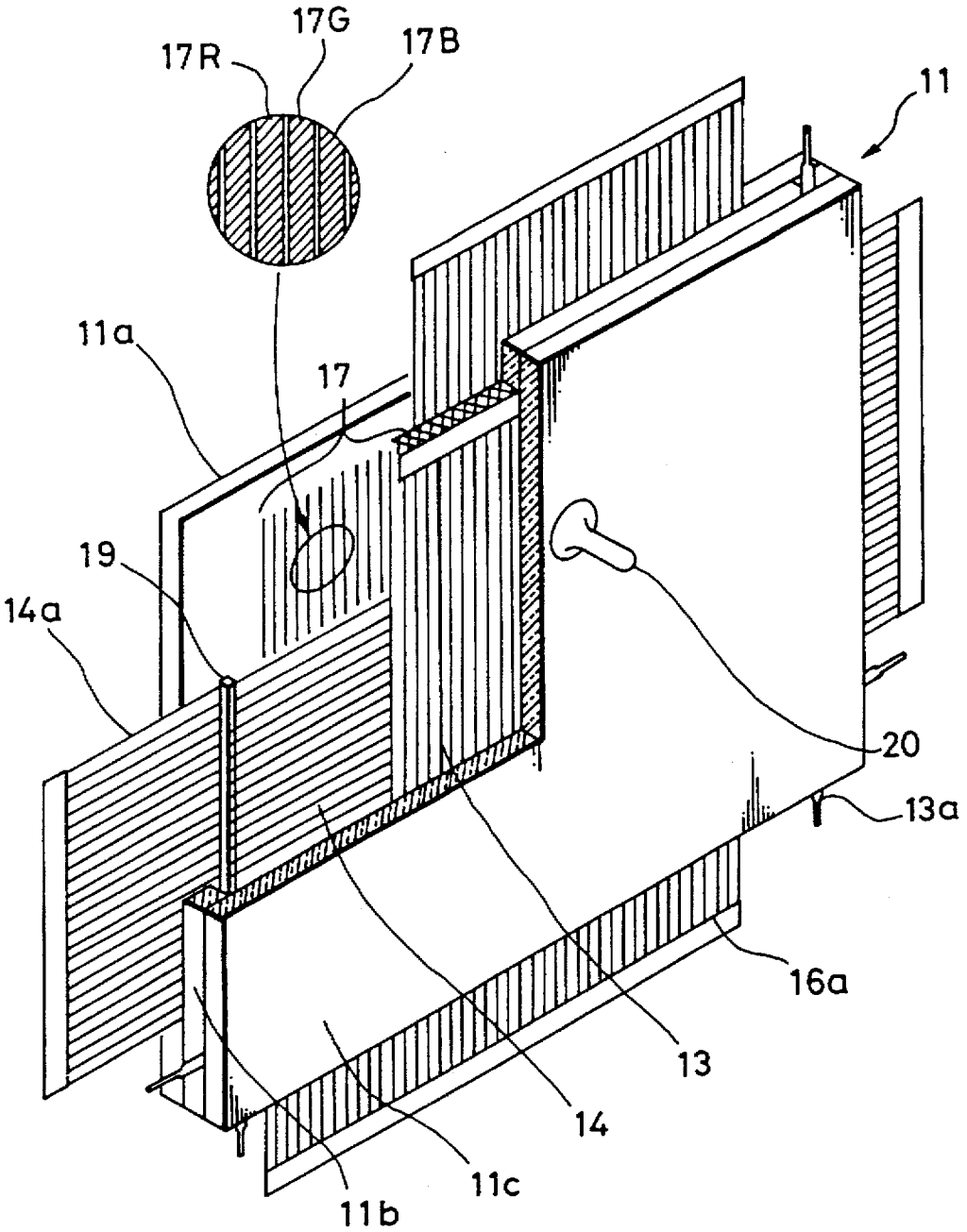
FIG. 4 is a fragmentary perspective view of a front-emission graphic phosphor display panel according to the present invention which incorporates the principles of the display device shown in FIGS. 3A and 3B.

FIG. 4 shows in fragmentary perspective a front-emission graphic phosphor display panel according to the present invention which incorporates the principles of the display device shown in FIGS. 3A and 3B. As shown in FIG. 4, the front-emission graphic phosphor display panel includes a faceplate 11*a*, a pair of spaced side plates 11*b*, and a backplate 11*c* which are joined together providing a hermetically sealed housing 11, which is evacuated through an exhaust pipe 20 mounted on the backplate 11*c*. A color filter layer composed of color filters as shown in FIG. 3B is disposed on the inner surface of the faceplate 11*a*. A striped phosphor layer 17 which is composed of phosphor layers 17R, 17G, 17B is disposed on ITO layers (not shown) which serve as an anode that are disposed on the color filter layer.

The front-emission graphic phosphor display panel also has a grid 14 in the form of closely spaced parallel wires extending perpendicularly to the striped phosphor layer 17 and spaced therefrom by a spacer 19 of glass. A plurality of filaments 13 serving as a cathode are disposed between the grid 14 and the backplate 11*c* and extend in the same direction as the striped phosphor layer 17. The grid 14, the ITO layers, and the filaments 13 are electrically connected to external circuits by grid leads 14*a*, anode leads 16*a*, and filament leads 13*a* that extend respectively therefrom.

A process of manufacturing the display device shown in FIGS. 3A and 3B will be described below with reference to FIGS. 5A through 5I.

Figure 5A:
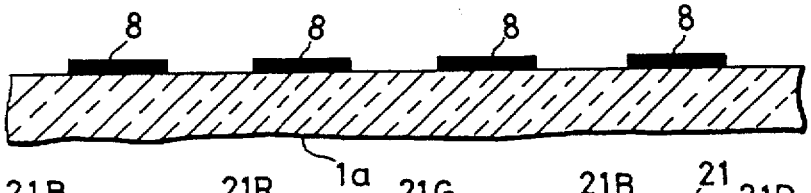
FIG. 5A through 5I are fragmentary cross-sectional views showing a process of manufacturing the display device.

First, as shown in FIG. 5A, a number of parallel black stripes 8 are formed on a faceplate 1*c* according to a known procedure.

Figure 5B:
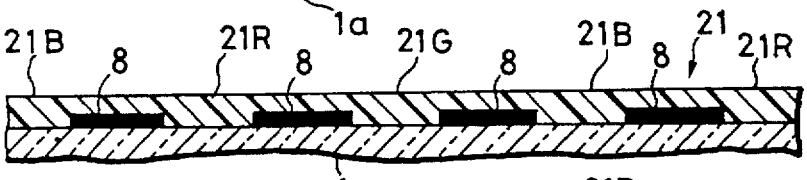

Then, as shown in FIG. 5B, the faceplate 1*a* and the black stripes 8 are coated on their entire surfaces with a PVA-ADC photosensitive liquid or an azido photosensitizer (such as of polyvinyl pyrrolidone) 21, which is thereafter dried.

Areas 21G, 21B of the coated layer 21 which correspond to green and red color filters are exposed to ultraviolet radiation using a color selecting mask (not shown).

Figure 5C:
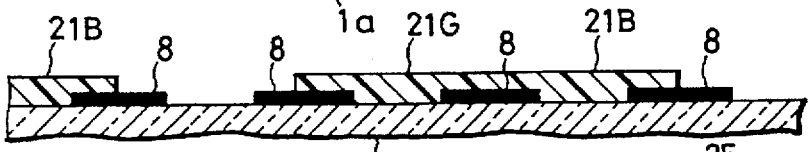

Thereafter, the surface of the coated layer 21 is developed using pure water, thus removing areas 21R corresponding to red filters as shown in FIG. 5C.

Figure 5D:
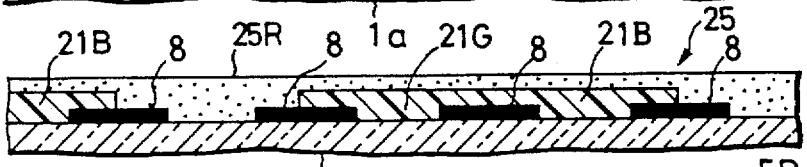

A suspension is prepared which is composed of 90% of water and 10% of a red pigment (e.g., DEFIC-R1007 (trade name) manufactured by The Dowa Mining Co. Ltd.) comprising fine particles of iron oxide ($Al_2O_3$). The suspension is coated on the surface formed so far, and dried into a suspension layer 25 as shown in FIG. 5D.

Figure 5E:
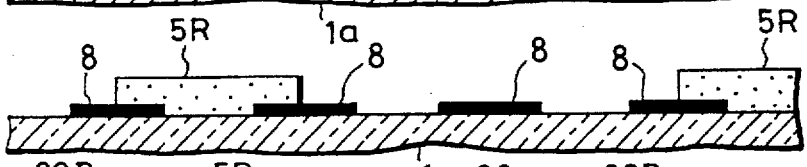

After an aqueous solution of hydrogen peroxide is sprayed over the suspension layer 25, it is developed in reverse with 10 weight % of pure water, thereby removing the photosensitizer and the pigment from those areas except the areas 25R. In this manner, red filters 5R are completed as shown in FIG. 5E.

Figure 5F:
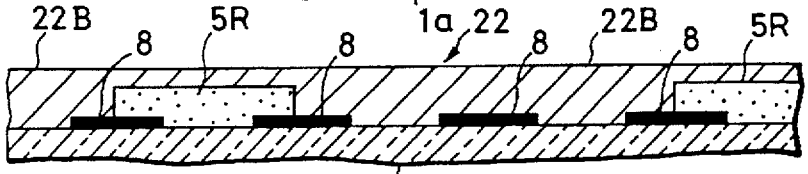

Then, the surface formed so far is coated with a PVA-ADC photosensitive liquid in which there is dispersed a blue pigment (e.g., Dyepyroxide TM blue #3410 (trade name) manufactured by Dainichiseika Color and Chemicals Corp.) composed of fine particles of CoO.$Al_2O_3$, and the coated PVA-ADC photosensitive liquid is dried into a layer 22 as shown in FIG. 5F.

Areas 22B of the layer 22 which correspond to the blue filters are exposed to ultraviolet radiation using a color selecting mask (not shown).

Figure 5G:
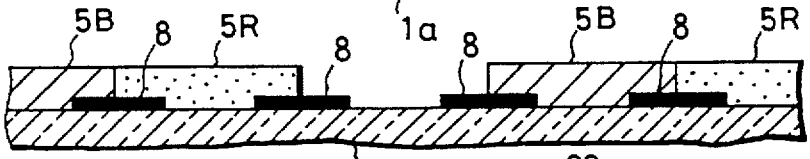

Thereafter, the surface of the coated layer 22 is developed using pure water, thus removing the unwanted photosensitizer and the pigment. In this manner, blue filters 5B are completed in addition to the red filter 5R as shown in FIG. 5G.

Figure 5H:
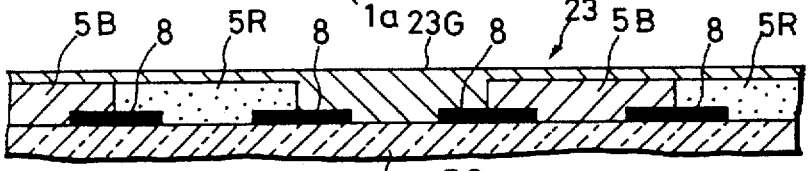

Subsequently, the surface formed so far is coated with a PVA-ADC photosensitive liquid in which there is dispersed a green pigment (e.g., Dyepyroxide TM blue #3320 (trade name) manufactured by Dainichiseika Color and Chemicals Corp.) composed of fine particles of $TiO_2$.ZnO.CoO.NiO, and the coated PVA-ADC photosensitive liquid is dried into a layer 23 as shown in FIG. 5H.

Areas 23G of the layer 23 which correspond to the green filters are exposed to ultraviolet radiation using a color selecting mask (not shown).

Figure 5I:
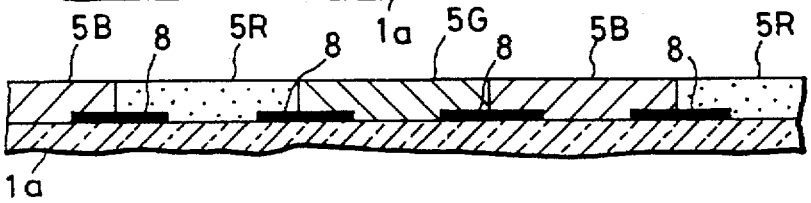

Thereafter, the surface of the coated layer 23 is developed using pure water, thus removing the unwanted photosensitizer and the pigment. In this manner, green filters 5G are completed in addition to the red and blue filters 5R, 5B as shown in FIG. 5I.

Then, as shown in FIG. 3B, the ITO layers 6 and the phosphor layers 7 are formed on the filters 5R, 5G, 5B.

Figure 6A:
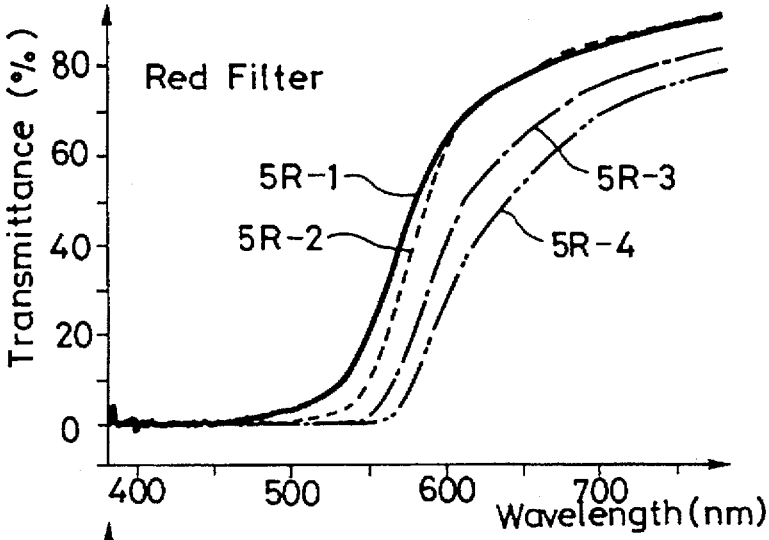
FIGS. 6A through 6C are diagrams showing transmittance characteristics of filter layers of the display device.
Figure 6B:
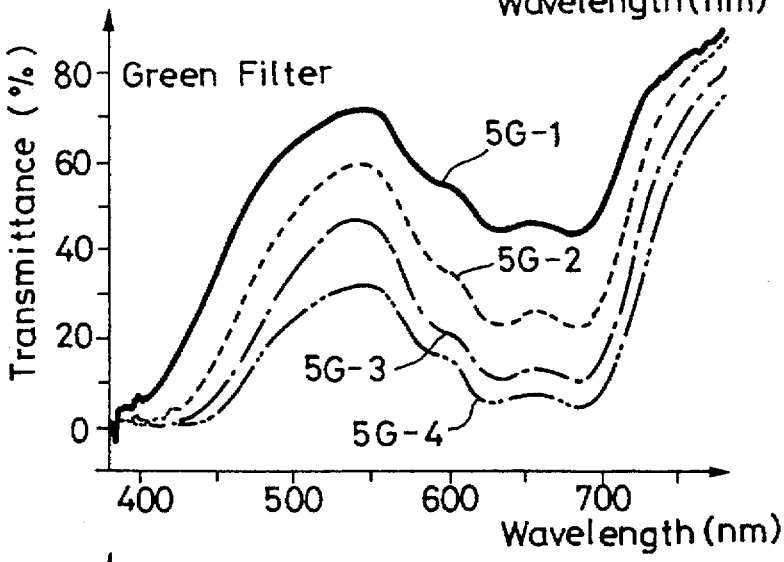
Figure 6C:
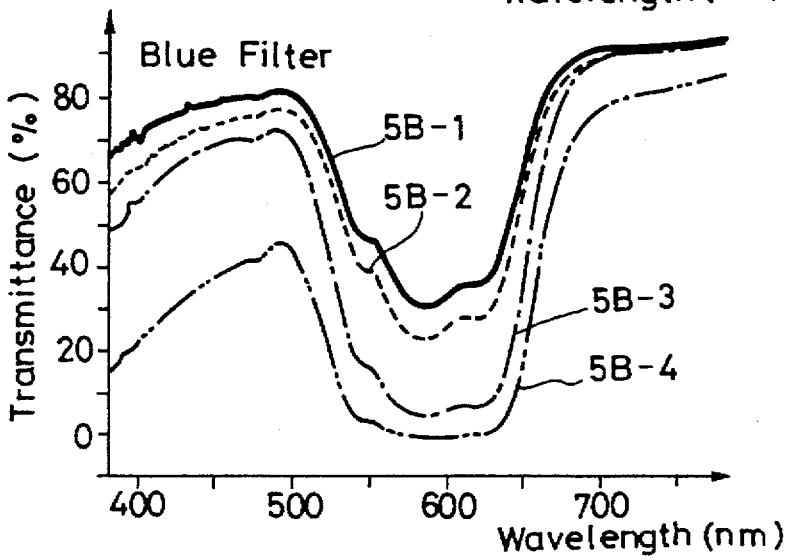

The chromaticity points of the red, green, and blue filters 5R, 5G, 5B which have different transmittances were measured, and the results are shown in FIGS. 6A through 6C, and 7 and Table 1 below. The transmittance and relative luminance without color filters was set to 100%, and four types of color filters 5R-1~4, 5G-1~4, 5B-1~4 were formed for the respective colors as shown in FIGS. 6A through 6C and Table 1.

TABLE 1

| | Phosphor ZnO:Zn Chromaticity point | | |
|---|---|---|---|
| Filter | x | y | Relative luminance |
| 5R - 1 | 0.459 | 0.500 | 21% |
| 5R - 2 | 0.512 | 0.470 | 15% |
| 5R - 3 | 0.567 | 0.419 | 7% |
| 5R - 4 | 0.595 | 0.389 | 4% |
| 5G - 1 | 0.230 | 0.460 | 66% |
| 5G - 2 | 0.229 | 0.503 | 52% |
| 5G - 3 | 0.226 | 0.541 | 39% |
| 5G - 4 | 0.225 | 0.585 | 24% |
| 5B - 1 | 0.179 | 0.349 | 56% |
| 5B - 2 | 0.171 | 0.340 | 50% |
| 5B - 3 | 0.134 | 0.284 | 33% |
| 5B - 4 | 0.116 | 0.260 | 16% |
| No filters | 0.228 | 0.394 | 100% |

(Note) The relative luminance was 100% with no color filters.

Figure 7:
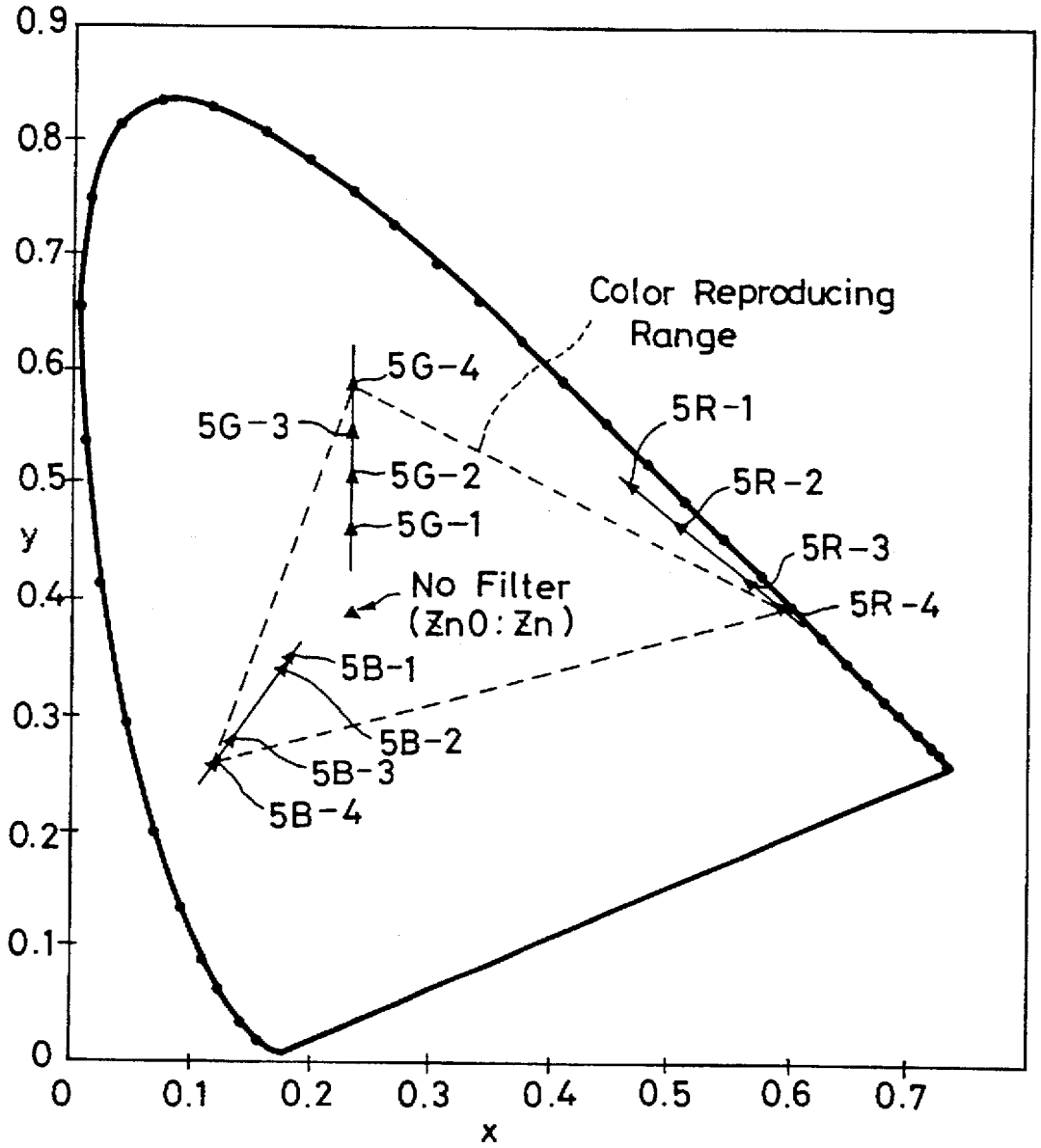
FIG. 7 is a diagram illustrative of a color reproducing range of the color filters of the display device on a CIE chromaticity diagram.

As can be understood from Table 1 and FIG. 7, a highly luminous phosphor display panel having a much wider color reproducing range than conventional phosphor display panels could be achieved according to the above embodiment of the present invention. Furthermore, the contrast of displayed images can be increased according to the above embodiment of the present invention.

The phosphor layers may be made of any of various other materials than ZnO:Zn. For example, phosphor layers of $SnO_2$:Eu may be disposed on the red filters. The phosphor layers of $SnO_2$:Eu have luminance and chromaticity that are much higher with respect to the red filters than phosphor layers of ZnO:Zn, as shown in Table 2 below.

TABLE 2

| | Phosphor $SnO_2$:Eu | | |
|---|---|---|---|
| | Chromaticity point | | Relative |
| Filter | x | y | luminance |
| 5R - 1 | 0.598 | 0.401 | 60% |
| 5R - 2 | 0.600 | 0.399 | 56% |
| 5R - 3 | 0.607 | 0.393 | 37% |
| 5R - 4 | 0.614 | 0.385 | 23% |

(Note) The relative luminance was 100% with no color filters.

The principles of the present invention are not limited to the illustrated embodiment, but may be applied to cathode-ray tubes, plasma display panels, or the like.

According to the present invention, as described above, the display device employs color filters containing dispersed fine particles of inorganic metal compounds of $Fe_2O_3$, $TiO_2$.NiO.CoO.ZnO, or CoO.$Al_2O_3$. Therefore, the display device, particularly a color phosphor display panel, has a wide color reproducing range and a high luminance.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A display device comprising:

a faceplate;

a color filter layer comprising red, green, and blue filters disposed on said faceplate, said filter layer containing fine particles of inorganic metal compounds;

an anode disposed on the color filter layer;

a phosphor layer disposed on the anode;

a cathode for emitting thermions toward said phosphor layer; and a grid disposed in spaced relation between said phosphor layer and said cathode for controlling a flow of thermions emitted from said cathode toward said phosphor layer, wherein said green filter contains fine particles of $TiO_2$.ZnO.CoO.NiO.

2. A display device according to claim 1, wherein said fine particles of inorganic compounds have a particle size ranging from 0.01 μm to 0.02 μm.

3. A display device according to claim 1, wherein said red filter contains fine particles of $Fe_2O_3$.

4. A display device according to claim 1, wherein the anode is an indium tin oxide layer.

5. A display device according to claim 1, wherein said phosphor layer is made of ZnO:Zn.

6. A display device comprising:

a faceplate;

a color filter layer comprising red, green, and blue filters disposed on said faceplate, said filter layer containing fine particles of inorganic metal compounds:

an anode disposed on the color filter layer;

a phosphor layer disposed on the anode;

a cathode for emitting thermions toward said phosphor layer; and a grid disposed in spaced relation between said phosphor layer and said cathode for controlling a flow of thermions emitted from said cathode toward said phosphor layer, wherein said blue filter contains fine particles of CoO.$Al_2O_3$.

7. A display device according to claim 6, wherein said fine particles of inorganic compounds have-a particle size ranging from 0.01 μm to 0.02 μm.

8. A display device according to claim 6, wherein said red filter contains fine particles of $Fe_2O_3$.

9. A display device according to claim 6 wherein the anode is an indium tin oxide layer.

10. A display device according to claim 6, wherein said phosphor layer is made of ZnO:Zn.

* * * * *